US008641590B2

(12) United States Patent
Smith et al.

(10) Patent No.: US 8,641,590 B2
(45) Date of Patent: Feb. 4, 2014

(54) SHEET FOLDER

(75) Inventors: Damon Peter Smith, Loughton (GB); Paul Francis Hitchings, Chelmsford (GB); David John Barrett, Romford (GB)

(73) Assignee: Neopost Technologies, Bagneux (FR)

( * ) Notice: Subject to any disclaimer, the term of this patent is extended or adjusted under 35 U.S.C. 154(b) by 168 days.

(21) Appl. No.: 13/017,890

(22) Filed: Jan. 31, 2011

(65) Prior Publication Data

US 2012/0004085 A1 Jan. 5, 2012

(30) Foreign Application Priority Data

Feb. 1, 2010 (GB) ..... 1001604.6

(51) Int. Cl.
*B65H 45/14* (2006.01)

(52) U.S. Cl.
USPC ..... 493/421; 493/419; 493/420; 493/442

(58) Field of Classification Search
USPC ..... 493/419, 420, 421, 434, 442, 408, 416
See application file for complete search history.

(56) References Cited

U.S. PATENT DOCUMENTS

| | | | | |
|---|---|---|---|---|
| 4,573,672 | A | 3/1986 | Lehmann et al. | |
| 4,717,134 | A | 1/1988 | Iida et al. | |
| 4,834,699 | A | 5/1989 | Martin | |
| 7,094,195 | B1 * | 8/2006 | Lindsay | 493/419 |
| 2002/0117793 | A1 * | 8/2002 | Hosoya et al. | 270/4 |

FOREIGN PATENT DOCUMENTS

| | | | |
|---|---|---|---|
| EP | 2 003 078 | A1 | 12/2008 |
| JP | 61-217476 | A | 9/1986 |
| JP | 2002-255446 | A | 9/2002 |

OTHER PUBLICATIONS

European Search Report for EP11152258, dated Mar. 1, 2011.
UK Search Report dated May 18, 2010 for GB 1001604.6.

* cited by examiner

*Primary Examiner* — Alexandra Elve
*Assistant Examiner* — Adam Moon
(74) *Attorney, Agent, or Firm* — Sughrue Mion, PLLC

(57) ABSTRACT

A sheet folder comprising input rollers, exit rollers and a fold box having a fold plate which is curved substantially along its whole length, wherein the curved fold plate is configured to induce a sheet to curve in two different directions during the folding process.

11 Claims, 5 Drawing Sheets

SHEET FOLDER

The present invention relates to apparatus for folding and particularly to a sheet folder for a paper handling apparatus, such as is used for preparing documents for insertion into envelopes, for example in preparing mass mailings.

In a typical such paper handling apparatus a letter of one or more sheets of paper is printed and collated with one or more items of insert material such as information leaflets, advertising flyers and return envelopes and each collation of documents is inserted into an envelope. Usually letters are printed on A4 size sheets of paper and must be folded to fit into C5 or DL envelopes, which are commonly used in the mail.

Sheets may be folded once, i.e. into two panels, in a so-called V-fold. Alternatively they may be folded twice, into three panels, either in a so-called Z-fold, which sandwiches a middle panel of the sheet between the outer two panels, or a C-fold in which one of the outer panels is sandwiched between the other outer panel and the middle panel.

One traditional folder is a buckle fold apparatus. The document to be folded is fed by rollers into a dead-end fold box defined by parallel fold plates and a back-stop. The leading edge of the document encounters the back-stop, but the trailing edge continues to be driven forward by the rollers. Consequently the document buckles about a line between the leading and the trailing edge determined by the depth of the box in relation to the length of the document. The buckling portion is caught in the nip of exit rollers, positioned at the top of the fold box, which complete the fold by flattening the fold line and drawing the folded document out of the fold box. A typical such buckle folding device is described in U.S. Pat. No. 4,647,029. The process may be repeated, either in the same fold box or in a second fold box, if two folds are required, for example for a Z- or C-fold. Apparatus for folding a Z- or C-fold is described for example in U.S. Pat. No. 5,819,666.

To accommodate a variety of sizes of documents to be folded, and different fold lengths, such fold boxes are relatively long and the back-stop is adjustable along the length of the fold plates. Long fold boxes are however difficult to incorporate into compact folding machines, and require special stands. Hence they are not suitable for use in desk-top or table-top folders or mailing machines, which are thus restricted to certain sizes of paper and envelope. It would be advantageous to have more versatility in such smaller machines so that they can also be used for a variety of lengths of documents. Even in full size, non-compact machines, there is often a requirement for clearance to other machine features and a smaller footprint to save space.

Fold plates incorporating a curved portion have been used in some machines to maintain a small footprint but known such curved fold plates do not accommodate multiple sheet folding because of the larger roller diameters and clearances required, which result in the forms being less controlled. Known curved fold plate systems also do not cope successfully with curled input sheets (which tends to happen when the sheets have passed recently through a printing machine).

Thus it can be seen that in certain conditions a curved fold box may be more likely to result in damage to a document being folded, compared to a straight fold box, because the document tends naturally to take the same shape as the fold box. Hence the resultant curved document sometimes does not feed reliably into the nip of the folding exit rollers, which can then cause damage to the document. This is a particular problem with a C-fold because the leading edge of the document becomes the leading edge of the inside panel of the three panels and tends to curve away from the nip of the output folding rollers which sometimes results in this edge being damaged.

According to the present invention there is provided a sheet folder comprising input rollers, exit rollers and a fold box having a fold plate which is curved substantially along its whole length, wherein the curved fold plate is configured to induce a sheet to curve in two different directions during the folding process.

Such a curved fold box occupies a smaller footprint than a straight fold box and is thus more suitable for compact machines. With a curve extending substantially the whole length of the fold plates the document to be folded is less likely to snag on abrupt corners which could cause damage to the document.

Inducing an S-shape in the document to be folded effectively 'breaks the back' of the document to be folded, and forces the S shape through all of the panels of the folded sheet or sheets. The curved fold plate preferably comprises a relatively small portion which curves in the opposite direction to the overall curve of the box. This portion is generally in the vicinity of the sheet entrance mark of the box and serves as a smooth transition for the sheets as they enter the fold box.

The curved fold box facilitates a simpler form of adjustable backstop since it can be mounted to be pivotable about a point generally at the focal point of the curve. This enables the backstop to be adjustable along the whole length of the fold box simply by manually turning the backstop about the pivot point, e.g. by turning and securing a knob or lever at the pivot point. This design also reduces the amount of mechanical hardware needed to mount the adjustable backstop.

The backstop can also be set automatically such as by using a controlled motor drive connected to the pivot point of the backstop.

According to a preferred embodiment of the present invention therefore the fold plate is configured to induce the sheet to curve in two different directions during the folding process, such as in the shape of an 'S'.

According to a second aspect of the present invention there is provided a sheet folder comprising: a first curved fold box for making a first fold in a sheet; a second curved fold box for making a second fold in the sheet; wherein the second fold box is adapted to induce an "S" shaped curve in the sheet.

According to a preferred embodiment of the invention a pivotably mounted adjustable backstop is provided for the or each fold box. It may be adjusted manually or automatically.

For a better understanding of the present invention and to show how the same may be carried into effect reference will now be made to the accompanying drawings in which.

Figure 1:
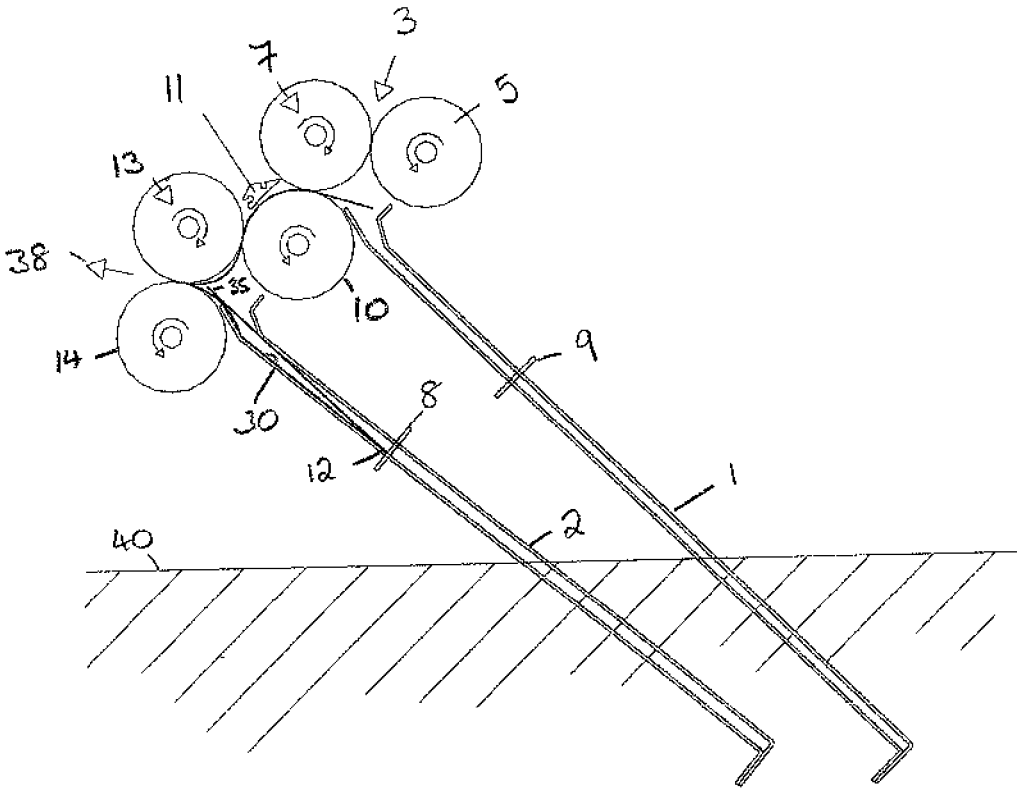
Figure 1 PRIOR ART
FIG. 1 is a schematic cross-section through a known buckling folder.

FIG. 1 shows a traditional buckle folder comprising two fold boxes 1 and 2 each box comprising a pair of linear straight fold plates. A sheet of paper, shown at 30, first enters the folder at input 3 and passes through the nip between a fixed roller 5 and a sprung roller 7 into the mouth of the first fold box 1. It is guided between the two plates of the first box 1 until the leading edge of the sheet 30 reaches a backstop 9. The rollers 5, 7 continue to drive the sheet 30 but the backstop 9 prevents it going further into the fold box 1 and causes it to be caught in the nip of the exit roller comprising the sprung roller 7 and a fixed roller 10. This nip folds the sheet 30 along a line spaced from the leading edge by the distance between the backstop 9 and the nip of the rollers 7 and 10. In the example shown this is one-third the length of the sheet, which is being folded in a C-fold configuration.

Thus a double thickness of paper sheet is pulled through the nip between the rollers 7 and 10 and is guided by a deflector 11 around fixed roller 10 and into the mouth of the fold box 2. The sheet 30 continues to be driven into the fold box 2 until the leading edge, which is now the folded edge 12, reaches a backstop 8 in fold box 2 as is shown in FIG. 1. Since the sheet 30 can go no further into the fold box 2, the trailing third section of it is driven around roller 13 into the nip of roller 13 and a third fixed roller 14, thus folding the sheet again along a line spaced from the leading fold edge 12 by the distance from the backstop 8 to the nip of the rollers 13 and 14. The original leading edge 35 of the sheet 30 becomes tucked into the fold and the folded sheet exits the folder in the direction of output arrow 38, folded into three panels in a traditional C-fold.

The line 40 indicates the lower limit of a compact folder and it will be seen that the traditional straight fold plates extend substantially beyond this limit and hence a special stand is required.

Figure 2:
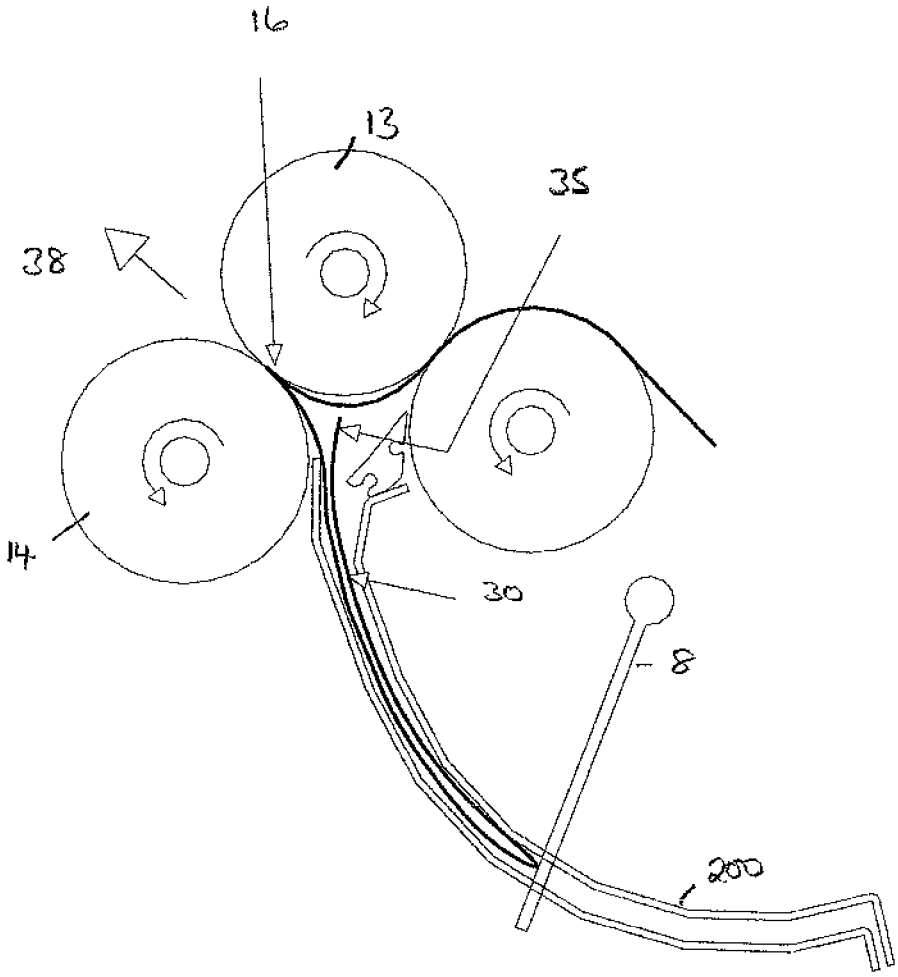
FIG. 2 is a schematic cross-section through a buckling folder according to the invention.

FIG. 2 illustrates a folder according to the invention in which a traditional straight fold box is replaced with a curved fold box 200. This is advantageous from a space point of view and allows a compact sheet folder to be accommodated on a normal table or desk without the need for a special stand.

However a problem can arise particularly when the second fold of a C-fold is being executed. The original leading edge 35 of the sheet 30 tends to get damaged as the sheet is pulled through the nip 16 of the exit rollers 13 and 14. This is because curved fold plates tend to make the sheet 30 adopt a curved 'S' shape and thus the original leading edge 35 is curved away from the nip 16 and does not engage into the second fold of the sheet 30 as cleanly as it does with straight fold plates.

Figure 3:
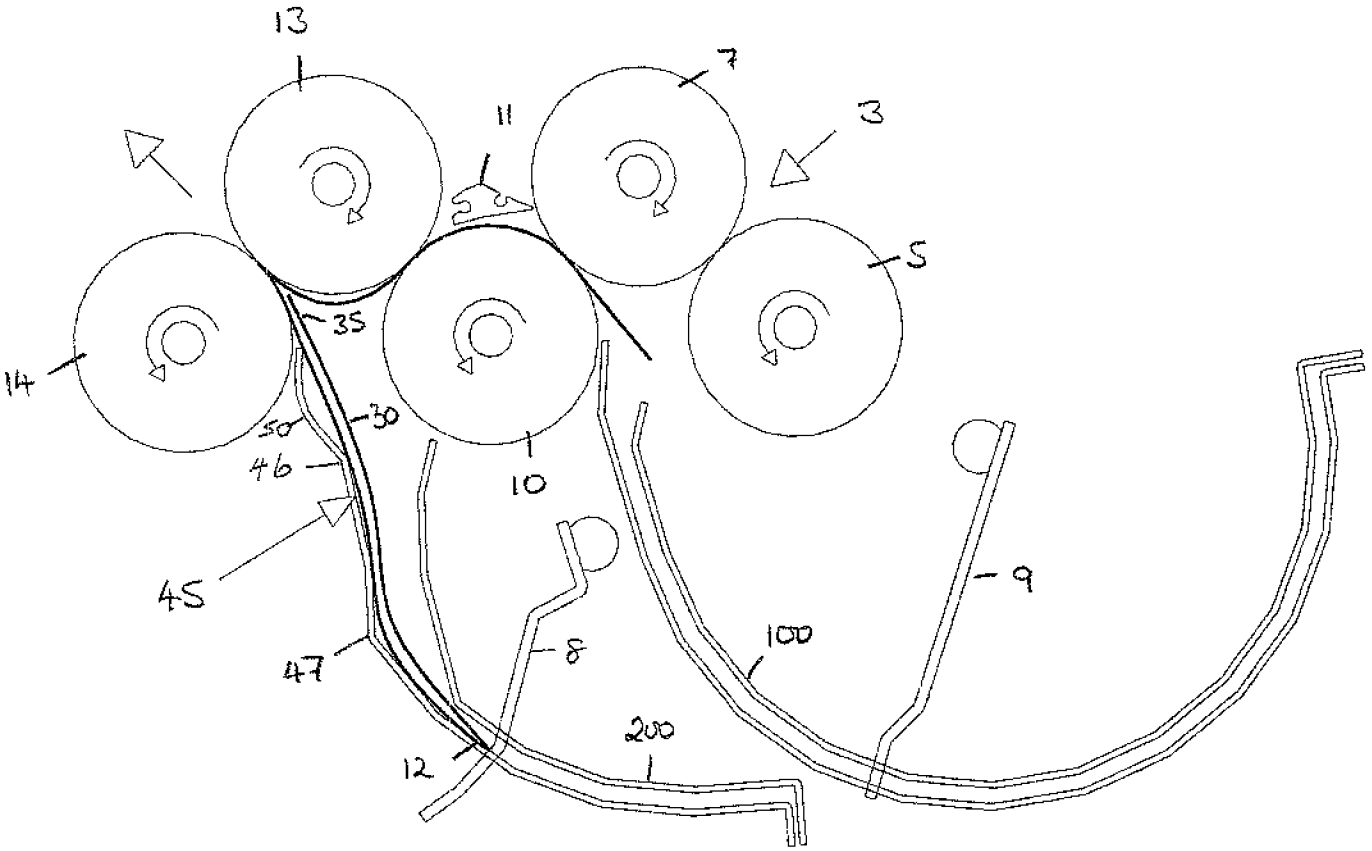
FIG. 3 is a schematic cross-section through a buckling folder according to a preferred embodiment of the invention.

In FIG. 3 the shape of the second fold box 2 is shown in more detail and comprises an additional curved portion 50, curved in the opposite direction to the general curve of the fold box 200 to assist a smooth transition for the sheets as they enter the fold box.

The outer fold plate 201 has a shape which breaks the back of the document to be folded. This shape comprises a generally convex portion in the region 45 between points 46 and 47 adjacent to a generally concave portion between portion 47 and backstop 8. Other shapes or indentations would achieve the same effect of breaking the back of the document, through all layers, but this shape is particularly effective. This portion 46 generally presents a convex surface to the folded sheet 30 and portion 47 presents a concave surface to the folded sheet 30.

This causes the sheet to adopt a double curve, such as in the form of an S shape in cross section, with the top bar of the S pointing towards the exit roller nip 16. In FIG. 3 such a backward S shape can be seen in the region of arrow 45 with the bulge of the upper curve being to the right and the bulge of the lower curve being to the left. This configuration tends to encourage the original leading edge 35 to bend toward the nip 16 of the exit rollers 13 and 14 and thus encourages the sheet edge 35 to tuck into the second fold as it is flattened by the rollers 13, 14. Hence this leading edge 35 is less likely to be damaged during the folding process.

The terms "curve" and "curved" as used in connection with the fold plates are intended to include any shape which is not linear. The curved shapes referred to may be arcs of circles or of ellipses or other non-straight shapes and the fold plates may comprise combinations of different curves along their lengths. The two fold plates of a fold box may be of different shapes and may taper together toward the backstop and diverge toward the input rollers.

A further fold plate can be substituted for the deflector which itself can be adjusted to shut off the fold plate 200 which results in a no-fold.

Figure 4:
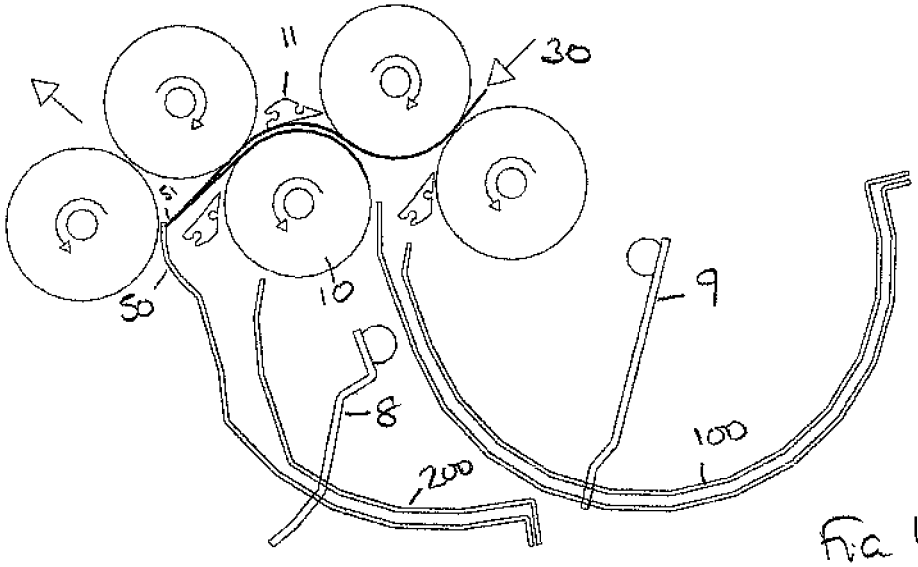
FIGS. 4 to 7 show a sequence of operations of the folder of the invention.
Figure 5:
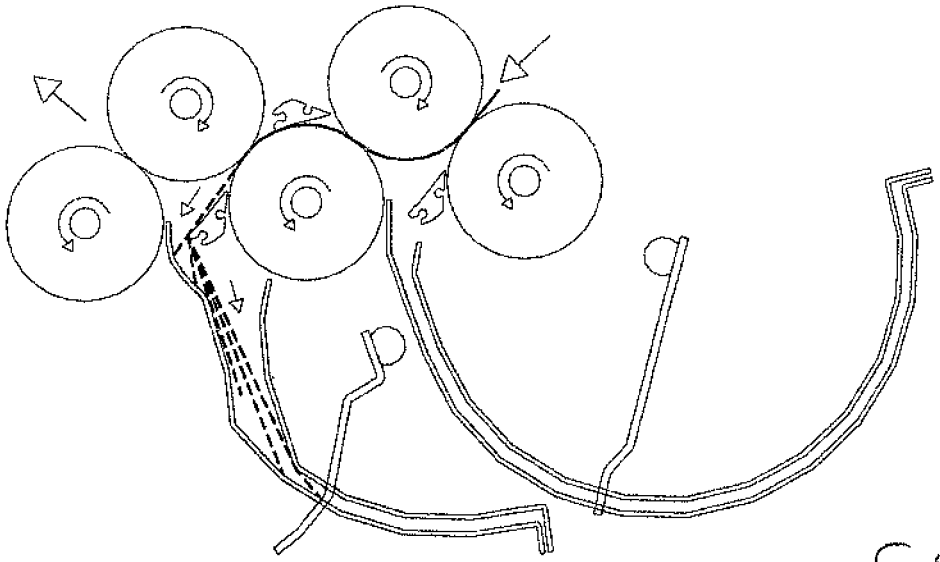
Figure 6:
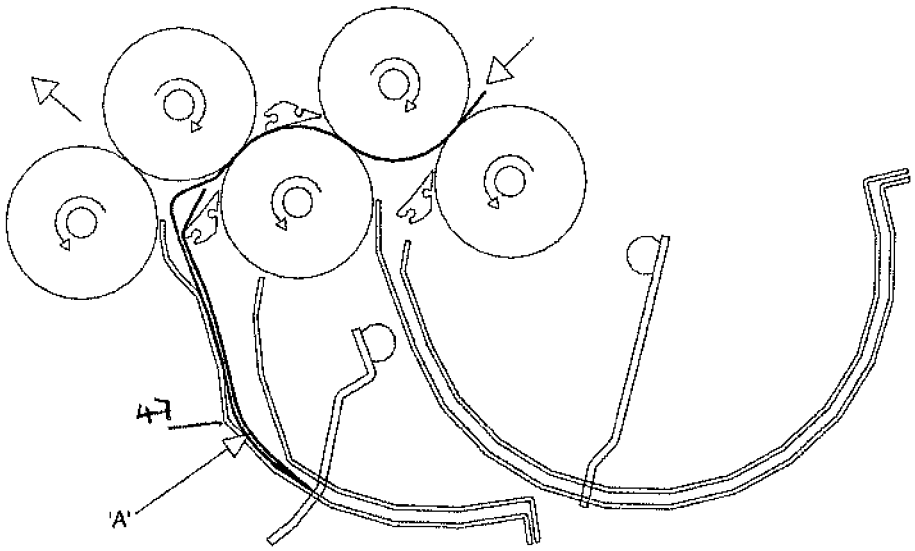
Figure 7:
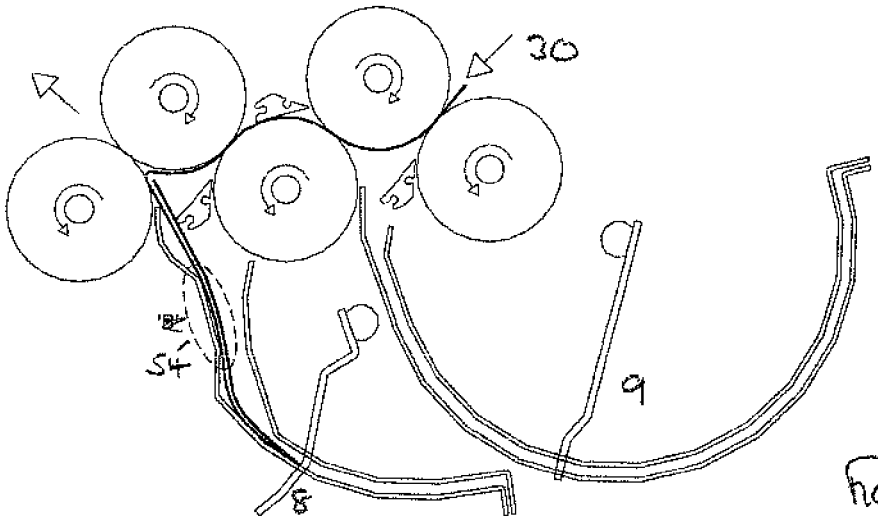

In FIG. 4 a sheet 30 has one fold already which has been formed in fold box 100. The leading fold edge 51 is shown touching the outer fold plate of fold box 200 in the uppermost convex shaped region 50. This fold edge 51 travels down the fold box as shown in FIG. 5 until it reaches the backstop 8. In FIG. 6 the leading edge 51 stalls against the backstop and as the sheet 30 is driven further into the fold box, the leading, folded, portion forms a convex shape and is driven into the indentation 47 and starts to buckle. As the buckle enters the nip point of the output fold rollers, the stalled portion of the sheet 30 forms an S shape around the fold plate geometry effectively breaking the back of the sheet in the area marked 54.

A sequence of the operation of the folder is shown in FIGS. 4 to 7.

What is claimed is:

1. A sheet folder comprising input rollers, exit rollers and first and second fold boxes each comprising an inner and an outer fold plate which are each curved substantially along their whole length, wherein the outer curved fold plate of the second fold box comprises in the vicinity of its entrance an additional curved portion that is curved in a direction opposite to a curve of other portions of the second fold box to induce a sheet to curve in two opposite directions for assisting a smooth transition for the sheet as it enters the second fold box and encouraging the sheet edge to tuck into the second fold as it is flattened by the exit rollers.

2. A sheet folder according to claim 1 wherein the outer curved fold plate of the second fold box is configured to induce an 'S' shape in the sheet.

3. A sheet folder as claimed in claim 1 wherein the outer fold plate of the second fold box comprises a portion shaped generally as an "S" in cross section.

4. A sheet folder as claimed in claim 1 wherein the outer fold plate of the second fold box comprises a portion which presents a concave surface to the sheet and a portion which presents a convex surface to the sheet.

5. A sheet folder as claimed in claim 1 wherein the outer fold plate of the second fold box has a major portion which is curved generally along an arc of a circle.

6. A sheet folder as claimed in claim 1 wherein the outer fold plate of the second fold box has a major portion which is curved along an arc of an ellipse.

7. A sheet folder as claimed in claim 1 wherein the second fold box further comprises an adjustable backstop.

8. A sheet folder as claimed in claim 7 wherein the backstop is adjusted by pivoting.

9. A sheet folder as claimed in claim 7 wherein the backstop is adjustable by rotation about a focal point.

10. A sheet folder comprising:

a first curved fold box for making a first fold in a sheet;

a second curved fold box for making a second fold in the sheet having an additional curved portion that is curved in a direction opposite to a curve of other portions of the second fold box to induce an "S" shaped curve in the sheet for assisting a smooth transition for the sheet as it enters the second curved fold box and encouraging a sheet edge to tuck into the second fold as it is flattened by exit rollers.

11. A sheet folder according to claim 1 adapted for multiple-sheet folding.

* * * * *